US011530544B2

(12) United States Patent
Powers, II et al.

(10) Patent No.: US 11,530,544 B2
(45) Date of Patent: Dec. 20, 2022

(54) REPLACEMENT GUTTER DRAIN

(71) Applicant: BAPO Products, Inc., Ponte Vedra, FL (US)

(72) Inventors: Douglas Alex Powers, II, Ponte Vedra, FL (US); Dean Baker, Ponte Vedra, FL (US)

(73) Assignee: BAPO PRODUCTS, INC., Ponte Vedra, FL (US)

( * ) Notice: Subject to any disclaimer, the term of this patent is extended or adjusted under 35 U.S.C. 154(b) by 0 days.

(21) Appl. No.: 16/947,813

(22) Filed: Aug. 18, 2020

(65) Prior Publication Data

US 2022/0056721 A1 Feb. 24, 2022

(51) Int. Cl.
*E04H 4/12* (2006.01)

(52) U.S. Cl.
CPC ..... *E04H 4/1227* (2013.01)

(58) Field of Classification Search
CPC ... E04H 4/1227; E04H 4/1218; E04H 4/1236; E04H 4/1245; E03D 5/0407; E03D 5/0408; E03D 5/0401; E03F 5/0407; E03F 5/0408; E03F 5/0401
See application file for complete search history.

(56) References Cited

U.S. PATENT DOCUMENTS

| | | | | |
|---|---|---|---|---|
| 1,186,540 | A * | 6/1916 | Booraem | E04H 4/1227 4/511 |
| 1,635,762 | A * | 7/1927 | McArdle | E04H 4/1227 4/596 |
| 2,982,970 | A * | 5/1961 | Robert | E04H 4/1227 4/511 |
| 4,067,072 | A * | 1/1978 | Izzi | E03F 5/0407 285/12 |
| 6,537,446 | B1 | 3/2003 | Sanguinetti | |
| 8,020,899 | B2 | 9/2011 | Hanna et al. | |
| 9,175,464 | B2 * | 11/2015 | Meyers | E03F 5/0408 |
| 10,334,839 | B2 | 7/2019 | Deurloo | |

FOREIGN PATENT DOCUMENTS

| | | | | |
|---|---|---|---|---|
| FR | 2588599 A1 * | 4/1987 | | E04H 4/1227 |

* cited by examiner

*Primary Examiner* — Erin Deery
(74) *Attorney, Agent, or Firm* — Mark Young, PA

(57) ABSTRACT

An original drain is removed from a pool gutter by cutting the joint where the drain tube joins the drain pipe. The remainder of the drain pipe is contained in a portion of the original drain tube. The replacement drain tube is inserted and bonded into the interior of the remaining drain pipe. A liquid flow path and reinforced joint are defined by the hopper of the replacement drain, original and replacement drain tubes, and the drain pipe. The top of the hopper of the replacement drain is tilted to about the slope of the gutter.

9 Claims, 10 Drawing Sheets

REPLACEMENT GUTTER DRAIN

FIELD OF THE INVENTION

This invention relates generally to swimming pool gutters, and, more particularly, to a replacement gutter drain and a method for replacing a gutter drain.

BACKGROUND

Commercial pools often have gutters. Eventually, pools, including gutters, require resurfacing. The resurfacing tends to cover old material and increase the height of the gutters. To keep the top of a gutter drain flush with the increased height of the gutter, pool resurfacers have devised a few techniques. One technique entails cutting a top portion of the installed drain structure and embedding it in the new surface material. This leaves a gap between top portion and the remainder of the drain structure. Even if the gap is cemented, over time, leaks develop at the gap.

A more drastic technique entails excavating down to the pipe to which the drain is attached. Then, the entire drain structure and a portion of the pipe is cut and removed. Then the cut pipe is extended with a coupler and a new gutter drain is installed at the correct height for the gutter. Problems with this approach are increased time and cost, for which a customer may be reluctant to pay. Additionally, the excavation may lead to collateral damage to nearby tiles and other structures.

A method and system are needed to efficiently replace gutter drains, without gaps and without excavation. The invention is directed to overcoming one or more of the problems and solving one or more of the needs as set forth above.

SUMMARY OF THE INVENTION

To solve one or more of the problems set forth above, in an exemplary implementation of the invention, a replacement gutter drain includes a removable cover with a plurality of drain apertures, a hopper with a top and a bottom, and a drain tube attached to and extending from the bottom of the hopper. The drain tube has an outer diameter, $d_O$, and a distal end. A drain pipe, which is fluidly coupled to pool recirculation plumbing, has an inner diameter, an outer diameter and a proximal end, e.g., top end. The distal end of the drain tube is sized and shaped to be securely received in the proximal end of the drain pipe. Additionally, a portion of a drain tube of a replaced drain has an inner diameter at least equal to the outer diameter of drain pipe. A portion of the drain pipe is securely received in the drain tube portion of the replaced drain. The outer diameter of the drain tube of the replacement drain is not greater than, but is about the same as, the inner diameter of the drain pipe. The inner diameter of the drain tube of the replaced drain is not less than, but is about the same as, the outer diameter of the drain pipe. A liquid flow path is defined by the hopper, drain tubes, and drain pipe. A joint is thus defined by the distal end of the replacement drain tube received in the proximal end of the drain pipe, and the proximal end of the drain pipe received in remaining portion of the replaced drain tube. This joint includes three concentric layers, including an inner layer comprising the distal end of the replacement drain tube, a medial layer comprising the proximal end of the drain pipe, and an outer layer comprising the distal end of the drain tube of the replaced drain. As a result of the multiple layers, such joint is structurally reinforced.

A bonding agent, such as a PVC cement, joins the distal end of the replacement drain tube to the proximal end of the drain pipe. By way of example and not limitation, the bonding agent may comprise a solution of polymers in a suitable solvent or solvent mix. The solvent mix for a PVC cement may include tetrahydrofuran (THF), or N-Methypyrrolidone (NMP), or dimethylsulfoxide (DMSO), or dimethylformamide (DMF), or others.

In one embodiment, the replacement drain is tilted. In such an embodiment, the tilt angle, θ, may be between a longitudinal axis of the drain tube and a central axis of the hopper. The tilt angle, θ, preferably is the same or approximately the same as the slope, φ, of the gutter in which the replacement drain is installed. The tilt angle, θ, may be 0° to 10°, more preferably 0° to 5°. A tilt angle of 0° (or the absence of tilt) is within the scope of the invention.

The gutter may comprise a cementitious structure formed from a base of sprayed concrete such as shotcrete or gunite. Typically, such gutters are finished with a plaster mortar, such as the crushed marble containing mortar known as marcite or any of various commercially available quartz aggregate or glass bead finishes. The base and finishing coating comprise the gutter structure. The hopper (i.e., at least most of the hopper), the drain tube and the joint of the replacement drain are contained in the cementitious structure of the gutter with the top of the hopper at about the top surface of the gutter. The top surface of the gutter typically has a slope.

While the replacement drain may comprise any of various materials, including plastics and metals, polyvinyl chloride (PVC) plastic is preferred. PVC is lightweight, cost-effective, durable, long-lasting and widely used in the industry.

A method of installing the replacement drain in a pool gutter includes cutting the joint defined by the proximal end of the drain pipe received in the distal end of the original drain tube. The joint may be cut using an internal pipe cutter. Upon cutting, a first portion of the original drain tube remains attached to and extends from the bottom of the original hopper of the original drain, a first portion of the drain pipe remains received in the first portion of the original drain tube, a second portion of the original drain tube is not attached to the bottom of the original hopper of the original drain, and a second portion of the drain pipe remains received in the second portion of the original drain tube. The original hopper of the original drain, first portion of the original drain tube, and first portion of the drain pipe are removed together as a unit. Upon removal, the second portion of the original drain tube and the second portion of the drain pipe are left in place. Then the replacement drain is installed by inserting the distal end of the replacement drain tube into the second portion of the drain pipe. A replacement joint is defined by the replacement drain tube received in the second portion of the drain pipe, and the second portion of the drain pipe received in the second portion of the original drain tube.

A bonding agent (e.g., PVC cement) is applied to the distal end of the replacement drain tube before inserting it into the second portion of the drain pipe. If necessary to achieve a desired elevation of the top of the hopper, the replacement drain tube may be trimmed to a determined length before inserting the distal end of the replacement drain tube into the second portion of the drain pipe. To determine the length of the drain tube, the replacement drain tube may be dry fit in the second portion of the drain pipe before trimming the replacement drain tube to a determined length and before applying a bonding agent. Upon installing the replacement drain, the top surface of the pool gutter is surfaced (e.g., finished with a mortar) to be substantially level with the top of the replacement hopper.

BRIEF DESCRIPTION OF THE DRAWINGS

The foregoing and other aspects, objects, features and advantages of the invention will become better understood with reference to the following description, appended claims, and accompanying drawings, where:

Figure 1:
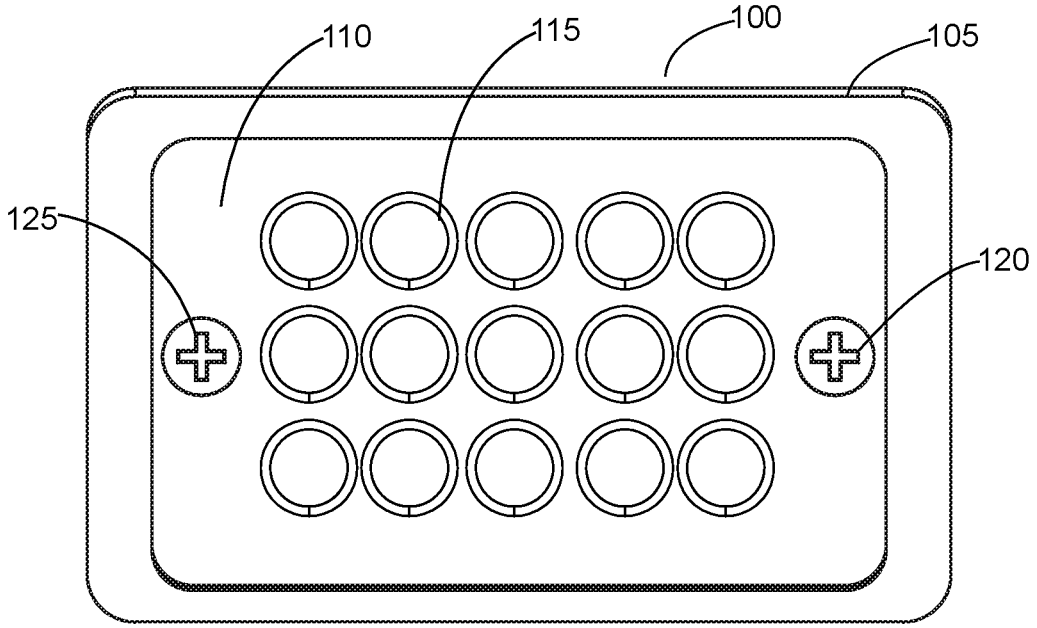
FIG. 1 is a plan view of an exemplary replacement gutter drain according to principles of the invention.
Figure 2:
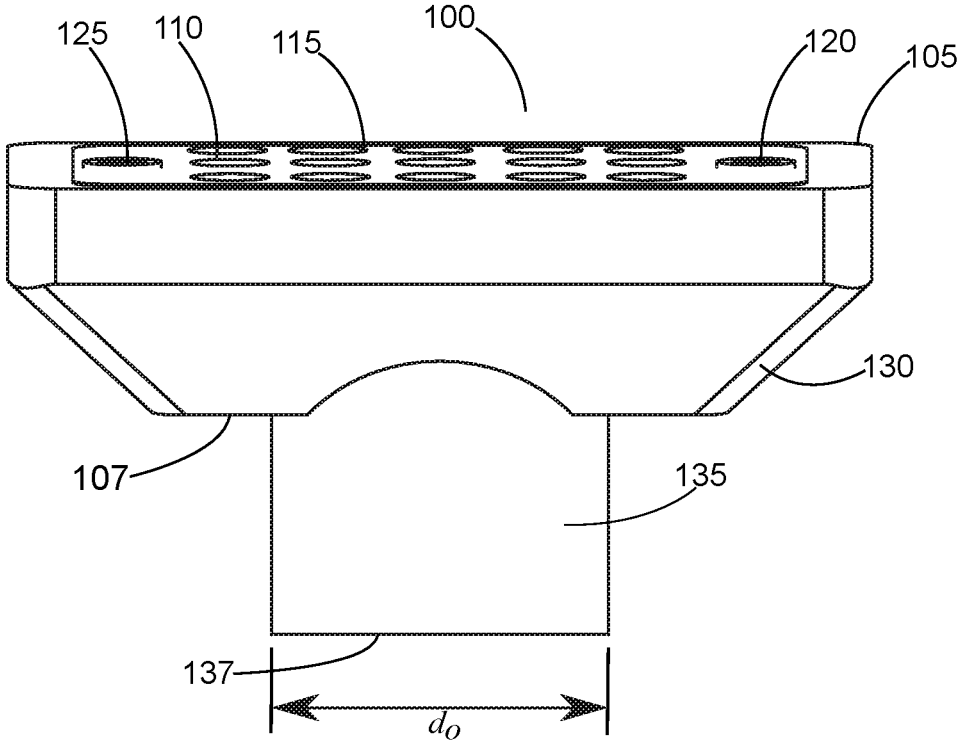
FIG. 2 is a front view of an exemplary replacement gutter drain according to principles of the invention.
Figure 3:
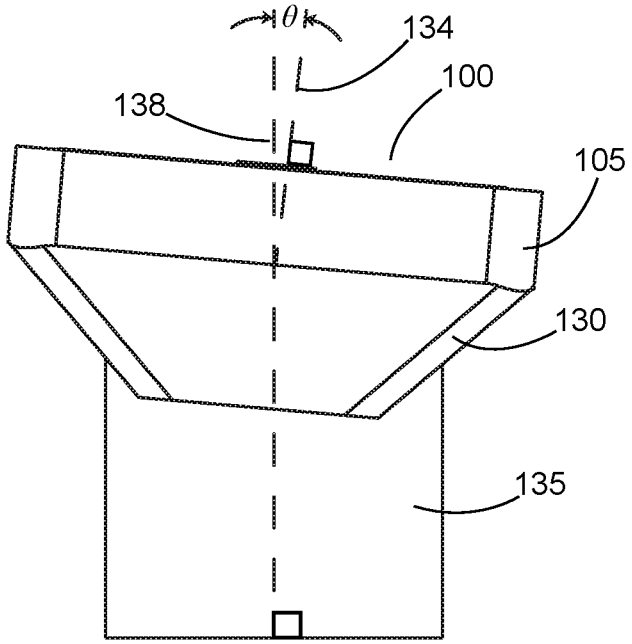
FIG. 3 is a side view of an exemplary replacement gutter drain according to principles of the invention.
Figure 4:
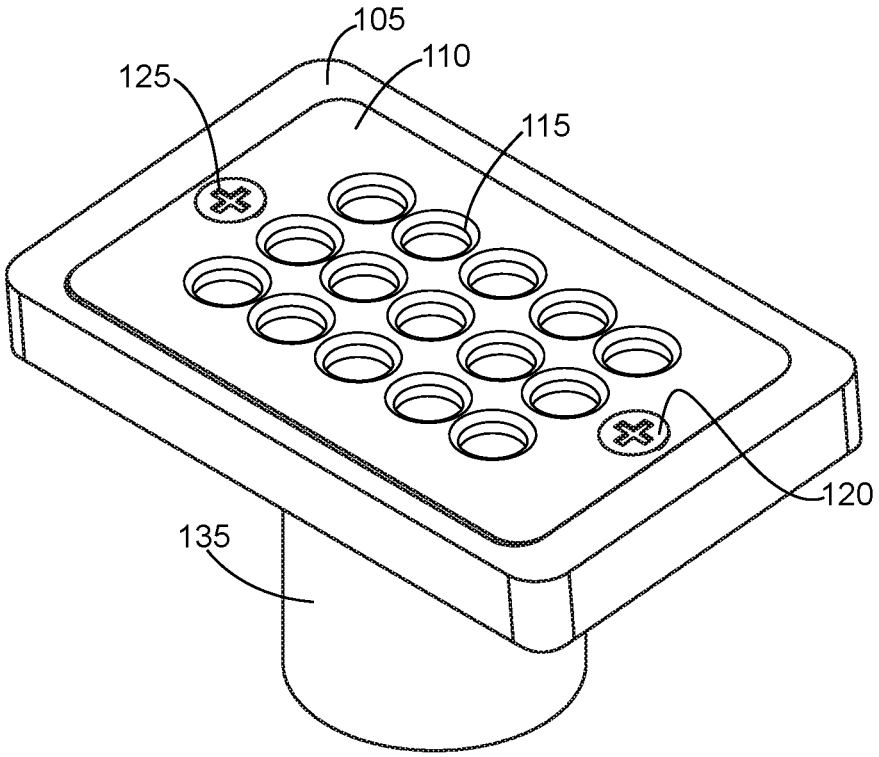
FIG. 4 is a top perspective view of an exemplary replacement gutter drain according to principles of the invention.

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Referring to the figures, an exemplary replacement drain for a pool gutter includes a removable cover 110 with a plurality of drain apertures 115, a hopper 130 with a top 105 and a bottom 107, and a drain tube 135 attached to and extending from the bottom 107 of the hopper 130. The drain tube 135 has an outer diameter, $d_0$, and a distal end 137. A drain pipe 250, which is fluidly coupled to pool recirculation plumbing, has an inner diameter, an outer diameter and a proximal end, e.g., top end. The distal end 137 of the drain tube 135 is sized and shaped to be securely received in the proximal end of the drain pipe 210. Additionally, a portion of a drain tube 215 of a replaced drain has an inner diameter at least equal to the outer diameter of drain pipe 250. A portion of the drain pipe 250 is securely received in the drain tube portion 215 of the replaced drain. The outer diameter of the drain tube 135 of the replacement drain 100 is not greater than, but is about the same as, the inner diameter of the drain pipe 250. The inner diameter of the drain tube 215 of the replaced drain is not less than, but is about the same as, the outer diameter of the drain pipe 250. A liquid flow path is defined by the hopper 130, drain tubes 135, 215 and drain pipe 250. A joint 220 is thus defined by the distal end 137 of the replacement drain tube 135 received in the proximal end of the drain pipe 250, and the proximal end of the drain pipe 250 received in remaining portion of the replaced drain tube 215. This joint 220 includes three concentric layers, including an inner layer comprising the distal end 137 of the replacement drain tube 135, a medial layer comprising the proximal end of the drain pipe 250, and an outer layer comprising the distal end of the drain tube 215 of the replaced drain. As a result of the multiple layers, such joint 220 is structurally reinforced.

A bonding agent, such as a PVC cement, joins the distal end 137 of the replacement drain tube 135 to the proximal end of the drain pipe 250. By way of example and not limitation, the bonding agent may comprise a solution of polymers in a suitable solvent or solvent mix. The solvent mix for a PVC cement may include tetrahydrofuran (THF), or N-Methyl-2-pyrrolidone (NMP), or dimethylsulfoxide (DMSO), or dimethylformamide (DMF), or others.

In one embodiment, the replacement drain 100 is tilted. In such an embodiment, the tilt angle, $\theta$, may be between a longitudinal axis 138 of the drain tube 135 and a central axis 134 of the hopper 130. The tilt angle, $\theta$, preferably is the same or approximately the same as the slope, $\varphi$, of the gutter 200 in which the replacement drain is installed. The tilt angle, $\theta$, may be 0° to 10°, more preferably 0° to 5°. A tilt angle of 0° (or the absence of tilt) is within the scope of the invention.

The gutter may comprise a cementitious structure formed from a base of sprayed concrete such as shotcrete or gunite. Typically, such gutters are finished with a plaster mortar, such as the crushed marble containing mortar known as marcite or any of various commercially available quartz aggregate or glass bead finishes. The base and finishing coating comprise the gutter structure. The hopper (i.e., at least most of the hopper), the drain tube and the joint of the replacement drain are contained in the cementitious structure of the gutter with the top of the hopper at about the top surface of the gutter. The top surface of the gutter typically has a slope.

While the replacement drain may comprise many different materials, including plastics and metals, polyvinyl chloride (PVC) plastic is preferred. PVC is lightweight, cost-effective, durable, long-lasting and widely used in the industry.

A method of installing the replacement drain 100 in a pool gutter 200 includes cutting the joint defined by the proximal end of the drain pipe 250 received in the distal end of the original drain tube 245. The joint may be cut using an internal pipe cutter. Upon cutting, a first portion of the original drain tube 245 remains attached to and extends from the bottom of the original hopper of the original drain 240, a first portion of the drain pipe 250 remains received in the first portion of the original drain tube 245, a second portion of the original drain tube 245 is not attached to the bottom of the original hopper of the original drain 240, and a second portion of the drain pipe 250 remains received in the second portion of the original drain tube 245. The original hopper of the original drain 240, first portion of the original drain tube 245, and first portion of the drain pipe 250 are removed together as a unit. Upon removal, the second portion of the original drain tube 245 and the second portion of the drain pipe 250 are left in place. Then the replacement drain 100 is installed by inserting the distal end of the replacement drain tube 135 into the second portion of the drain pipe 250. A replacement joint 220 is defined by the replacement drain tube 135 received in the second portion of the drain pipe 250, and the second portion of the drain pipe 250 received in the second portion of the original drain tube 245.

A bonding agent (e.g., PVC cement) is applied to the distal end of the replacement drain tube 135 before inserting it into the second portion of the drain pipe 250. If necessary to achieve a desired elevation of the top of the hopper, the replacement drain tube 135 may be trimmed to a determined length before inserting the distal end of the replacement drain tube 135 into the second portion of the drain pipe 250. To determine the length of the drain tube 135, the replacement drain tube 135 may be dry fit in the second portion of the drain pipe 250 before trimming the replacement drain tube 135 to a determined length and before applying a bonding agent. Upon installing the replacement drain 100, the top surface 215 of the pool gutter 200 is surfaced (e.g., finished with a mortar) to be substantially level with the top 105 of the replacement hopper 130.

FIGS. 1-4 conceptually illustrate an uninstalled exemplary replacement gutter drain 100 according to principles of the invention. A removable cover 110 with a plurality of apertures 115 is fastened to the top 105 of a hopper 130 with screws 120, 125. The apertures 115, which are not limited to any particular sizes, shapes, or configurations, allow pool water to freely flow into the hopper 130. In the exemplary embodiment, the apertures 115 comprise an array of circular openings with filleted or chamfered top edges to facilitate flow into the hopper 130. The hopper 130 is a funnel-like structure that directs liquid flow into a drain tube 135. The drain tube 135 is attached to and extends from the bottom of the funnel 130.

The exemplary replacement drain 100 is tilted to conform to the slope of the gutter. The tilt angle, θ, between a longitudinal axis 138 of the drain tube 135 and a central axis 134 of the hopper 130 is the same or approximately the same as the slope, φ, of the gutter 200 in which the replacement drain is installed. The tilt angle, θ, may be 0° to 10°, more preferably 0° to 5°. A tilt angle of 0° (or the absence of tilt) is within the scope of the invention.

Figure 5:
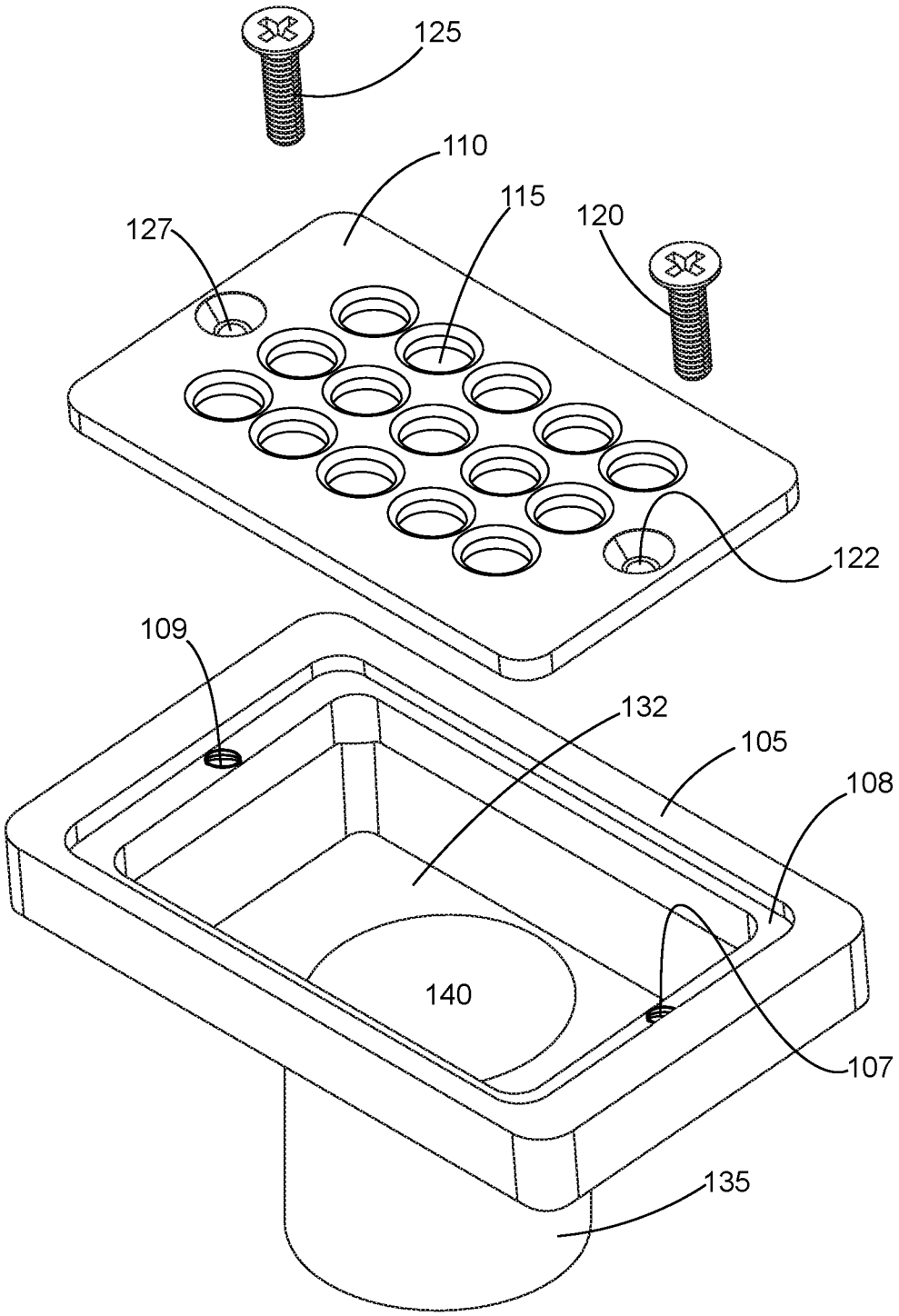
FIG. 5 is a top perspective exploded view of an exemplary replacement gutter drain according to principles of the invention.
Figure 6:
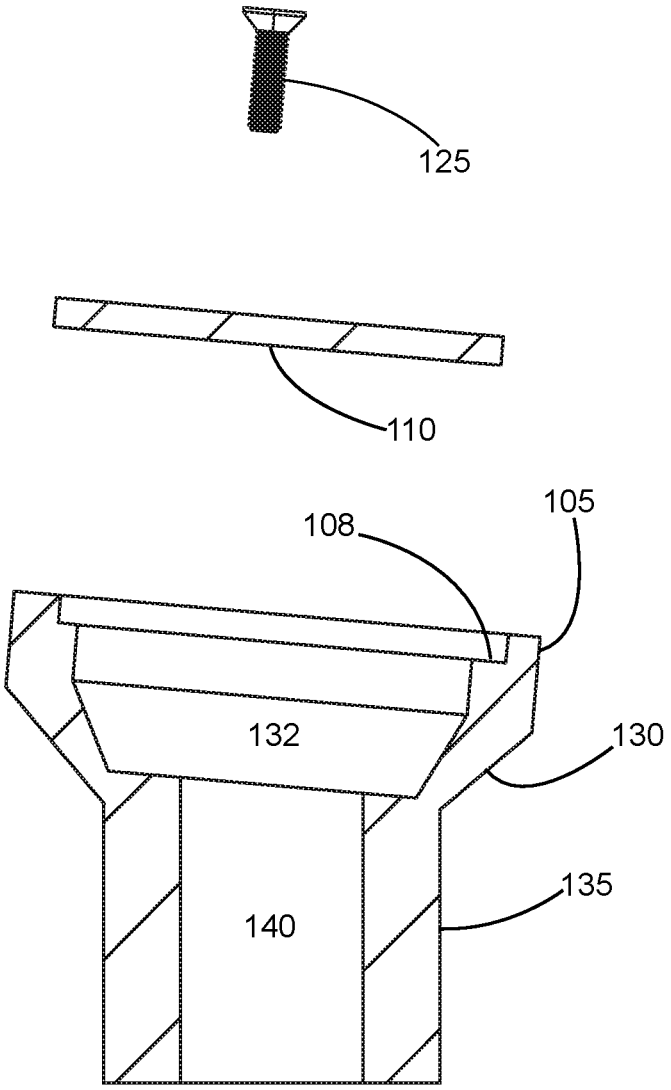
FIG. 6 is a side section exploded view of an exemplary replacement gutter drain according to principles of the invention.

FIGS. 5 and 6 provide exploded views of the uninstalled exemplary replacement gutter drain 100 according to principles of the invention. The screws 120, 125 and cover 110 are shown removed from the top 105 of the hopper 130. Recessed screw holes 122, 127 are provided in the cover 110. Corresponding threaded holes 107, 109 are provided in a ledge 108 of the hopper 130 to threadedly engage the threaded shanks of the screws 120, 125. The ledge 108 supports the cover 110.

The replacement drain 100 defines a liquid flow path from the top 105 of the hopper 130 to the drain tube 135 into a drain pipe 250. The hopper 130 defines an interior volume 132 for guiding liquid into the drain tube 135. The drain tube 135 defines an interior volume 140 for guiding liquid into the drain pipe 250. The drain tube 135 extends into the drain pipe 250, when the replacement drain 100 is installed.

Figure 7:
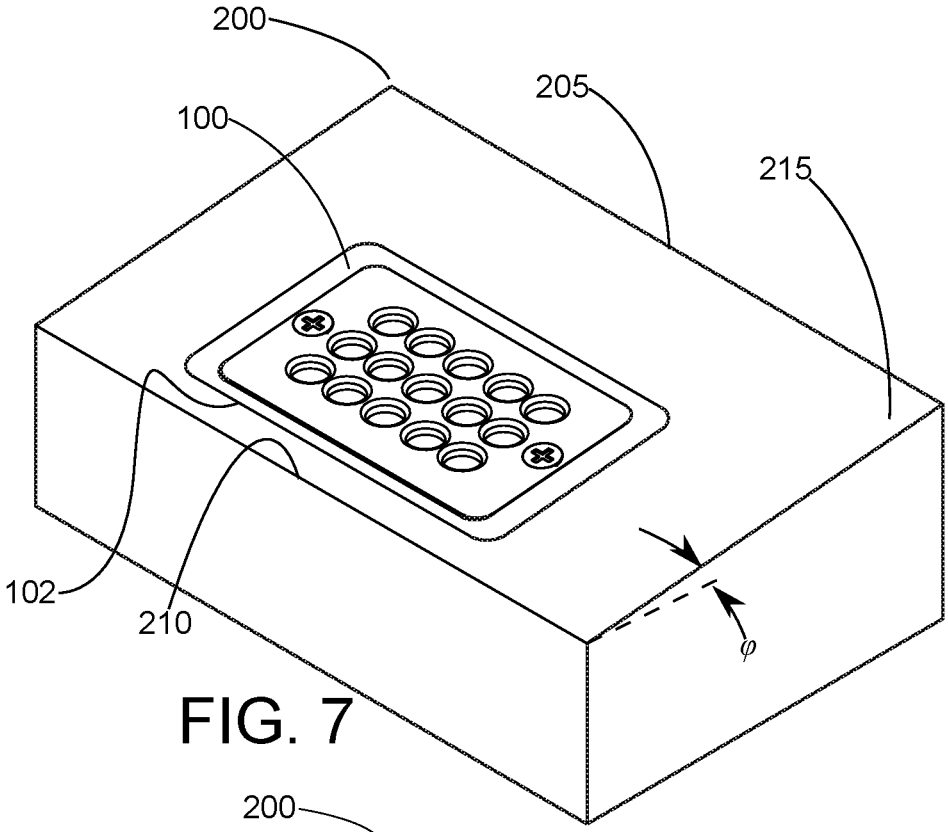
FIG. 7 is a top perspective view of a portion of a sloped gutter containing an exemplary replacement gutter drain according to principles of the invention.
Figure 8:
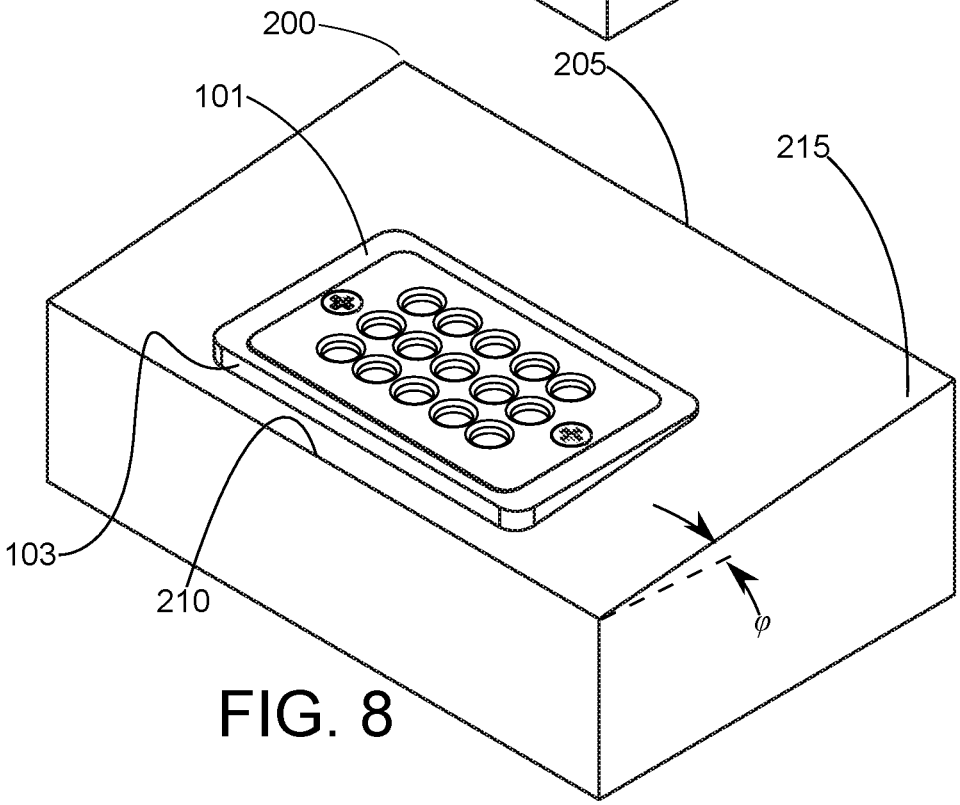
FIG. 8 is a top perspective view of a portion of a sloped gutter containing another exemplary replacement gutter drain according to principles of the invention.

Referring to FIGS. 7 and 8, top perspective views of a portion of a sloped gutter containing exemplary replacement gutter drains 100 according to principles of the invention are provided. The gutter is a cementitious structure formed from a base of sprayed concrete such as shotcrete or gunite and finished with a plaster mortar, such as a crushed marble containing mortar known as marcite or any of various commercially available quartz aggregate or glass bead finishes. The base and finishing coating comprise the gutter structure. The hopper 130 (i.e., at least most of the hopper), the drain tube 135 and the joint 220 of the replacement drain 100 are contained in the gutter structure, with the top 105 of the hopper 130 about flush with the top surface 215 of the gutter 200. The top surface 215 of the gutter 200 has a slope, φ.

In FIG. 7, the exemplary replacement drain 100 is tilted to conform to the slope of the gutter. The tilt angle, θ, is the same or approximately the same as the slope, φ, of the gutter 200 in which the replacement drain 100 is installed.

The tilt angle, θ, may be 0° to 10°, more preferably 0° to 5°. A tilt angle of 0° (or the absence of tilt) is within the scope of the invention.

In FIG. 8, the exemplary replacement drain 100 is not tilted to conform to the slope of the gutter. The tilt angle, θ, is less than the slope, φ, of the gutter 200 in which the replacement drain 100 is installed. Thus, the side of the drain 100 adjacent to the lower edge 210 of the sloped gutter 200 extends above the top surface 215 of the gutter 200, while the side of the drain 100 adjacent to the higher edge 205 of the sloped gutter 200 is about flush with the top surface 215 of the gutter 200. The side of the drain 100 adjacent to the lower edge 210 of the sloped gutter 200 may be made to appear flush by applying additional mortar between the edge 210 and the replacement drain 100.

Figure 9:
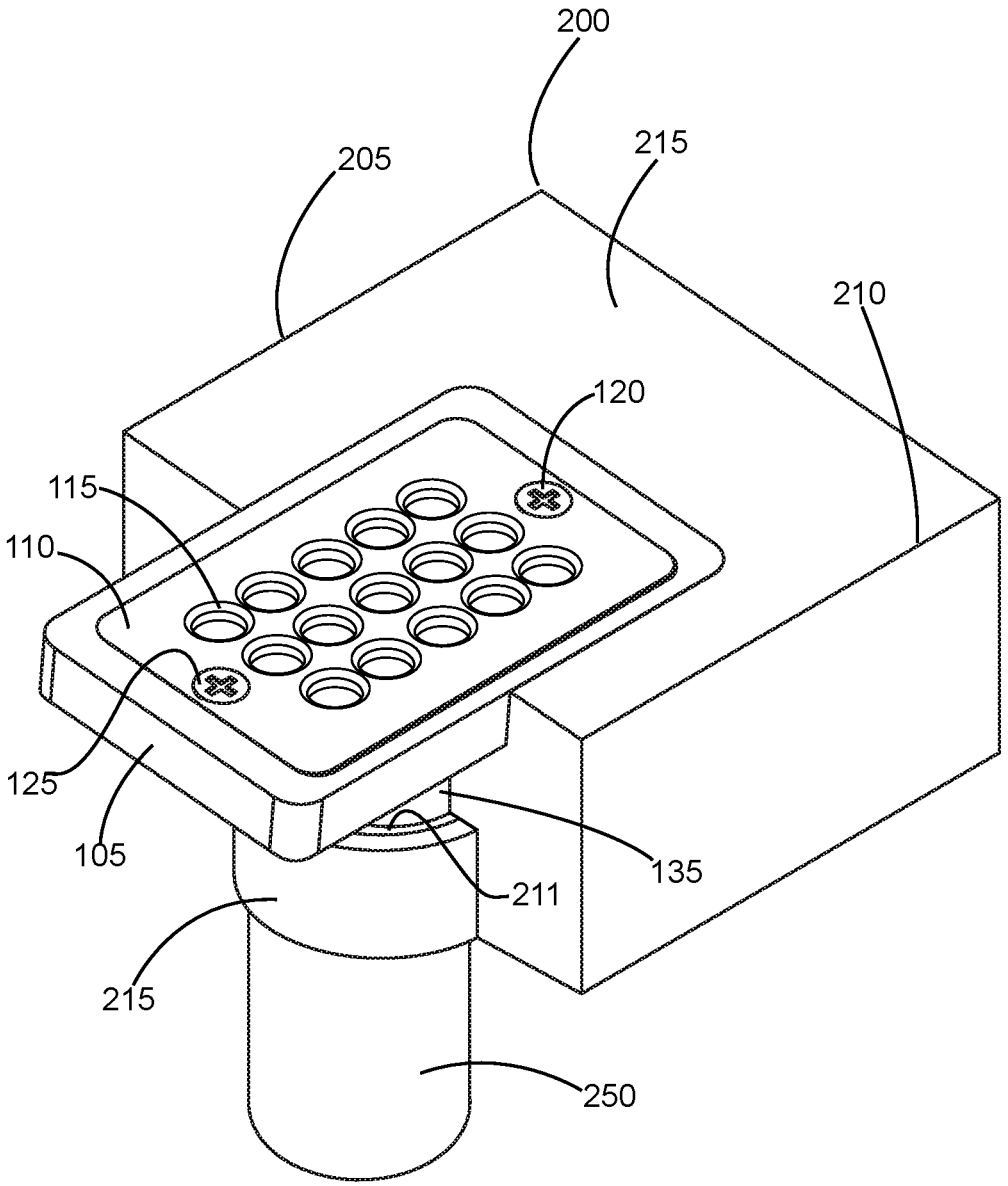
FIG. 9 is a top perspective view of a cutaway portion of a sloped gutter containing an exemplary replacement gutter drain according to principles of the invention.
Figure 10:
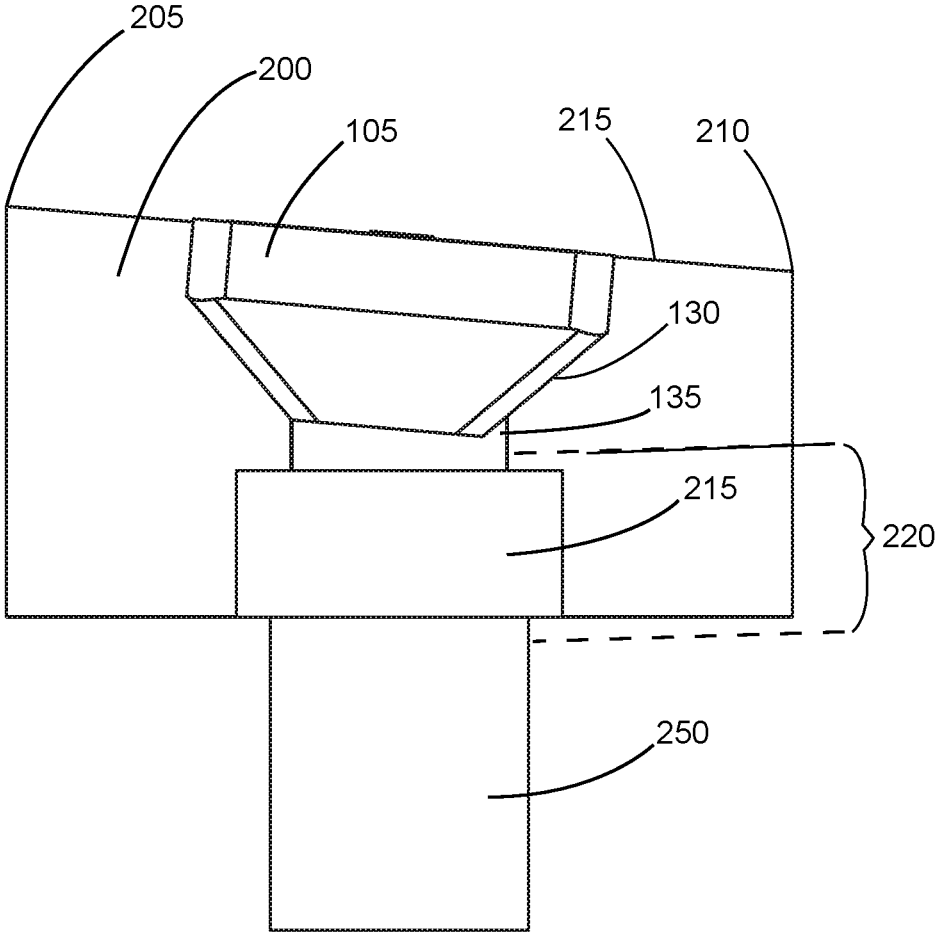
FIG. 10 is a side view of a cutaway portion of a sloped gutter containing an exemplary replacement gutter drain according to principles of the invention.

FIGS. 9 and 10 provide views of a cutaway portion of a sloped gutter 200 containing an exemplary replacement gutter drain 100 according to principles of the invention. Three concentric tubular layers form the joint 220. The joint 220 includes a portion of the replacement drain tube 135 secured inside the drain pipe 250, and a remaining portion of the replaced drain tube 215, in which a portion of the drain pipe 250 is securely received.

Heretofore, PVC fittings that couple to a PVC pipe (e.g., Schedule 40 pipe), receive a portion of the pipe within the fitting. A replacement drain 100 according to principles of the invention includes a drain tube 135, which is a fitting. Unlike prior PVC fittings, the drain tube 135 attaches to the drain pipe 250, which is typically a Schedule 40 PVC pipe with a 2" diameter, by sliding into and being securely received in the drain pipe 250. This arrangement is advantageous because the exterior surface of the drain pipe 250 is not only covered with a portion of a drain tube 215 from a replaced drain, but is also embedded in the gutter structure, typically a cementitious material. This arrangement facilitates joining the replacement drain 100 to the drain pipe 250 embedded in the gutter structure, without excavating the pipe 250.

Figure 11:
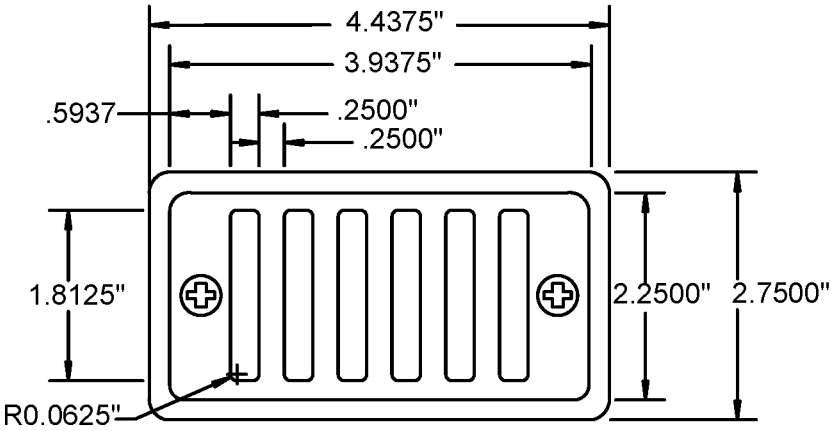
FIG. 11 is a plan view of an exemplary dimensioned replacement gutter drain according to principles of the invention.
Figure 12:
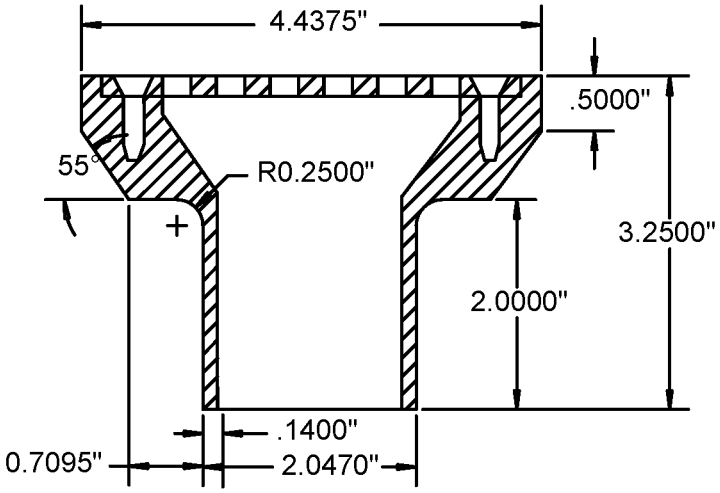
FIG. 12 is a front view of an exemplary dimensioned replacement gutter drain according to principles of the invention.

FIGS. 11 and 12 are dimensioned drawings of an exemplary replacement gutter drain according to principles of the invention. In this embodiment, the apertures are elongated slots. The dimensions are nonlimiting examples of suitable dimensions. The drain pipe 250 is typically a 2" nominal dimension PVC Schedule 40 pipe, which has and outer diameter of about 2.375", an inner diameter of about 2.047" and a wall thickness of about 0.154". In the exemplary embodiment, the outer diameter of the drain tube is about 2.047", which is the same as the inner diameter of a 2"

nominal dimension PVC Schedule 40 pipe, to provide a secure fluid-tight fit when installed. The outer diameter of the drain tube may be reduced by 1 to 2 thousandths without comprising the integrity of the joint. During installation, a PVC cement will occupy any space between the outer surface of the drain tube and the inner surface of the drain pipe.

If a drain pipe other than a 2" nominal dimension PVC Schedule 40 pipe is used, the dimensions of the drain tube 135 of the replacement drain 100 may be changed to fit the drain pipe. In particular, the outer diameter of the drain tube should be about equal to, but no greater than, the inner diameter of the drain pipe. By way of example and not limitation, the inner drain pipe 250 diameter of 2" nominal size PVC Schedule 80 pipe is 1.913".

Figure 13:
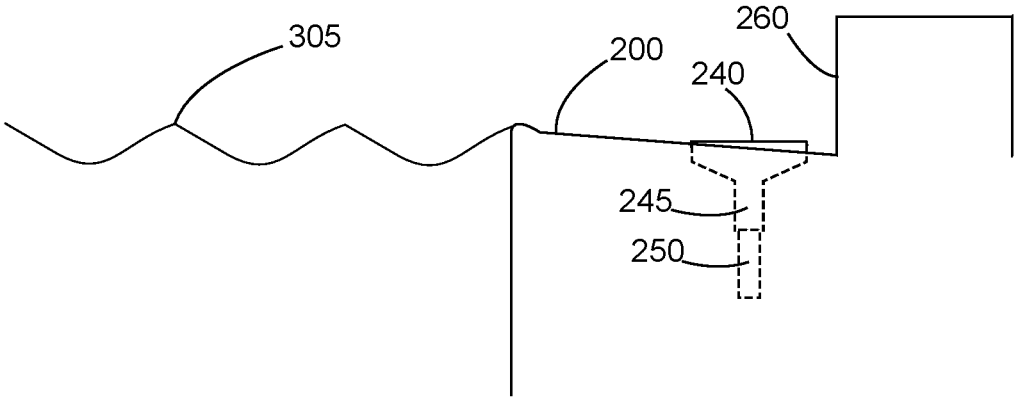
FIG. 13 is a schematic of a sloped gutter containing a gutter drain.

FIG. 13 provides a schematic of a sloped gutter 200 containing an original gutter drain 240 to be replaced. A raised curb 260 runs along the back edge of the gutter. The drain tube 215 of the drain 240 is coupled to the drain pipe 250. Only the portion of the drain pipe 250 is shown in the schematic. The joined end of the drain pipe 250 is securely received in the drain tube 215. Thus, the joined end of the drain tube 215 surrounds the joined end of the drain pipe 250. When the drain 240 is removed for replacement with a drain according to principle of the invention, a portion of the drain tube 245, in which the drain pipe 250 is received, remains, surrounding the received portion of the drain pipe 250.

Figure 14:
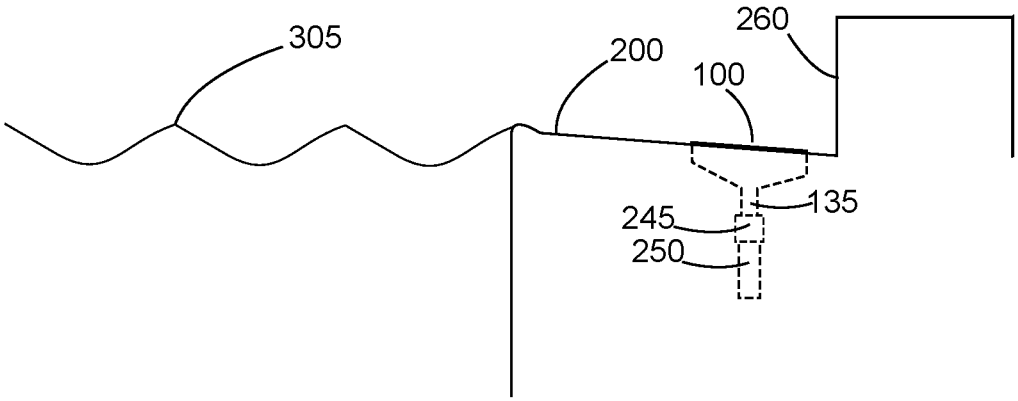
FIG. 14 is a schematic of a sloped gutter containing an exemplary replacement gutter drain according to principles of the invention.

FIG. 14 provides a schematic of a sloped gutter 200 containing an exemplary replacement gutter drain 100 according to principles of the invention. The replaced drain 240 has been removed, leaving behind a portion of the drain tube 245 of the replaced drain 240. The left behind portion of the drain tube 245 surrounds a portion of the drain pipe 250. A portion of the drain tube 135 of the replacement drain 100 is securely received in the drain pipe 250.

Figure 15:
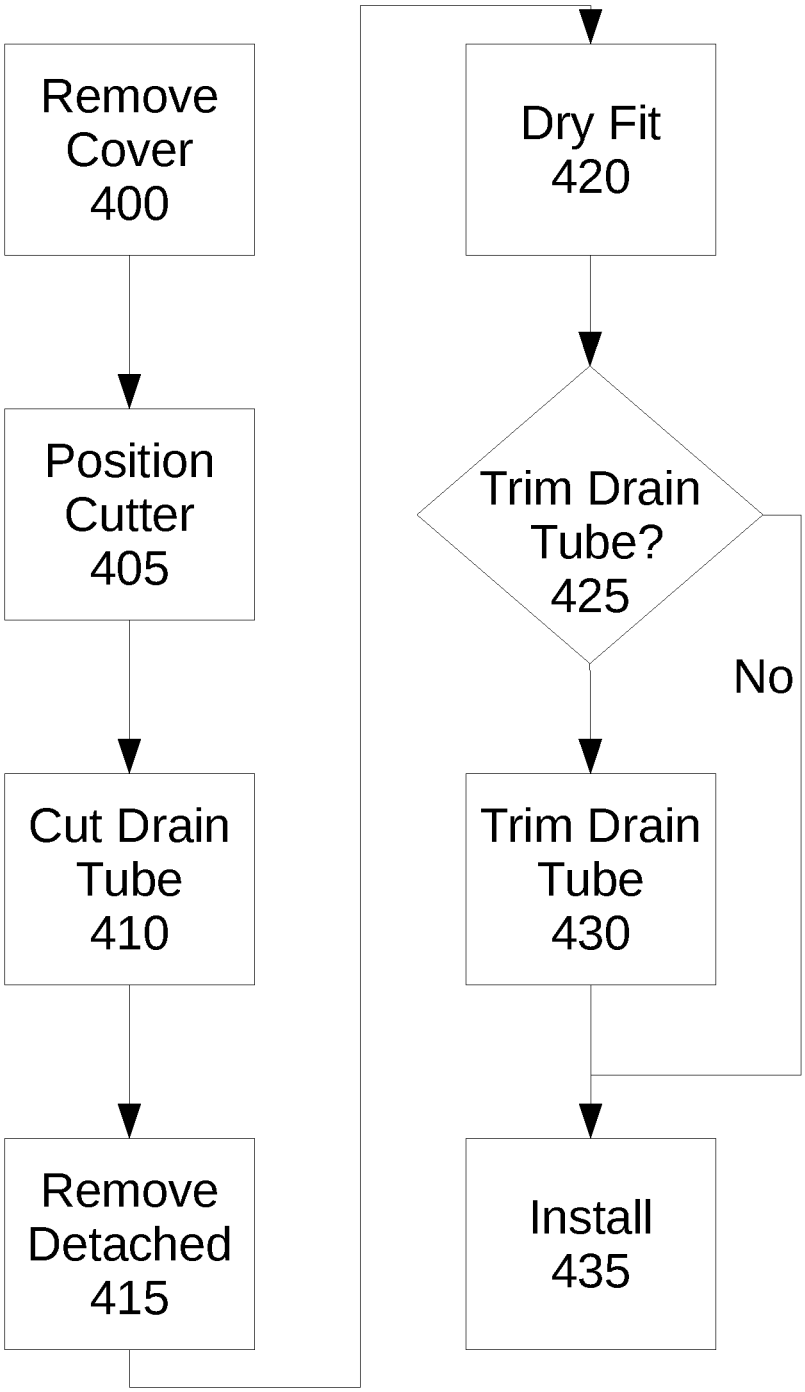
FIG. 15 is a flowchart for a method of replacing a gutter drain using an exemplary replacement gutter drain according to principles of the invention.

FIG. 15 is a flowchart for a method of replacing a gutter drain using an exemplary replacement gutter drain according to principles of the invention. The method entails steps of cutting, removal and installing, among others.

In step 400, the cover is removed from the drain to be replaced. Removal of the cover provides access to the interiors of the hopper and drain tube of the drain to be replaced.

In step 405, a cutter is positioned for cutting the drain to be replaced at the drain tube. The cutter is an internal pipe cutter. Positioning entails determining the location of the cut in the drain pipe. The drain pipe, and the surrounding portion of the drain tube, should be cut at a depth that allows mating of the drain tube of the replacement drain tube with the drain pipe. Thus, if the drain tube of the replacement drain is 2" in length, and a good joint requires at least ¾" inch of the drain tube inserted in the drain pipe, then the depth of the cut should not be deeper than 1.25" below the bottom of the hopper of the replacement drain.

After the position for the cut has been determined, the cut is made as in step 410. The cut is made using an internal pipe cutter, proceeding first through the drain pipe and then through the overlapping portion of the drain tube of the drain to be replaced.

After the cut, the severed portion of the drain to be replaced is removed, as in step 415. As the drain is typically comprised of PVC, which does not bond with the cementitious gutter structure, removal typically entails lifting or pulling the drain from the gutter structure, leaving behind a cavity shaped according to the outer surfaces of the removed portion of the drain. The cut portion of drain tube surrounding the drain pipe remains embedded in the gutter structure below the cavity.

Next the replacement drain is dry fitted, as in step 420. This entails inserting the hopper of the replacement drain entirely or partially in the cavity, with the drain tube of the replacement drain extending into the drain pipe. The top of the hopper should be at the desired elevation, i.e., an elevation flush with the top surface of the gutter when refinished.

After dry fitting, a determination is made whether or not to trim the drain tube of the replacement drain, as in step 425. By way of example, if the drain tube is 4" long and only 2" is needed, the drain tube may be cut to the needed length, as in step 430. As the replacement drain is not yet installed, the drain tube may be cut using an external or internal cutter.

After any trimming, the replacement drain is installed, as in step 435. Installation entails applying a bonding agent to the outer surface of a portion of the drain tube of the replacement drain, the portion being the portion to be inserted into the drain pipe. Optionally, the outer surface may be cleaned and primed before the bonding agent is applied. Then the portion of the drain tube to which the bonding agent is applied is inserted into drain pipe, and the hopper of the replacement drain is positioned fully or partially within the cavity in the gutter, with the top surface of the hopper about flush with the top surface of the gutter after refinishing.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A replacement drain in a pool gutter, the pool gutter comprising a structure with a planar top surface having a slope, the replacement drain comprising a removable cover with a plurality of drain apertures;

a hopper with a top and a bottom, the removable cover being attached to the top of the hopper;

a drain tube attached to and extending from the bottom of the hopper, the drain tube having an outer diameter and a distal end, a tilt angle between a longitudinal axis of the drain tube and a central axis of the hopper, the tilt angle being the same as the slope of the top surface of the pool gutter;

a drain pipe having an inner diameter, an outer diameter and a proximal end;

the distal end of the drain tube sized and shaped to be securely received in the proximal end of the drain pipe, a joint defined by the distal end of the drain tube received in the proximal end of the drain pipe, and the outer diameter of the drain tube not being greater than the inner diameter of the drain pipe; and a liquid flow path defined by the hopper, drain tube and drain pipe; and a tube portion of a replaced drain, the tube portion of the replaced drain having an inner diameter, the inner diameter of the tube portion of the replaced drain being at least equal to the outer diameter of the drain pipe, and a portion of the drain pipe, in which the distal end of the drain tube is securely received, being securely received in the tube portion of the replaced drain.

2. The replacement drain of claim 1 further comprising a bonding agent joining the distal end of the drain tube to the proximal end of the drain pipe.

3. The replacement drain of claim 2, the bonding agent comprising PVC cement.

4. The replacement drain of claim 1, the tilt angle being up to 10°.

5. The replacement drain of claim 4, the tilt angle being up to 5°.

6. The replacement drain of claim 4, the tilt angle being greater than 0°.

7. The replacement drain of claim 4, the top of the hopper being level with the top surface of the pool gutter.

8. The replacement drain of claim 7, the pool gutter being a cementitious structure.

9. The replacement drain of claim 1 comprising polyvinyl chloride plastic.

* * * * *